United States Patent [19]

Norman

[11] Patent Number: 4,737,977

[45] Date of Patent: Apr. 12, 1988

[54] DEVICE AND METHOD FOR SWITCHING COMMUNICATIONS AMONG TAXIS

[76] Inventor: Balduin Norman, Edelhofgasse 27, A-1180 Vienna, Austria

[21] Appl. No.: 939,885

[22] Filed: Dec. 9, 1986

[30] Foreign Application Priority Data

Dec. 9, 1985 [AT] Austria ..... 3564/84

[51] Int. Cl.[4] ..... H01Q 7/04

[52] U.S. Cl. ..... 379/58; 379/63; 455/54

[58] Field of Search ..... 379/56, 57, 58, 59, 379/60, 61, 63; 455/33, 54; 340/825.44, 825.49

[56] References Cited

U.S. PATENT DOCUMENTS

| | | | |
|---|---|---|---|
| 4,263,480 | 4/1981 | Levine | 379/57 |
| 4,471,352 | 9/1984 | Soulliard et al. | 340/825.44 |
| 4,515,994 | 5/1985 | Bolle et al. | 379/58 |
| 4,517,561 | 5/1985 | Burke | 340/825.07 |
| 4,575,582 | 3/1986 | Marino | 379/63 |
| 4,644,351 | 2/1987 | Zabarskv et al. | 340/825.44 |
| 4,658,416 | 4/1987 | Tanaka | 379/57 |
| 4,661,972 | 4/1987 | Kai | 379/57 |
| 4,672,657 | 6/1987 | Dershowitz | 379/63 |
| 4,672,658 | 6/1987 | Kavehrad | 379/63 |

FOREIGN PATENT DOCUMENTS

| | | | |
|---|---|---|---|
| 2749803 | 5/1979 | Fed. Rep. of Germany | 379/142 |

*Primary Examiner*—Robert Lev

*Attorney, Agent, or Firm*—Cushman, Darby & Cushman

[57] ABSTRACT

A user connected by telephone to a central telephone exchange can inform an automatic switching communications device directly of his own telephone number by dialing on his telephone set, which determines the corresponding address and all other possible characteristics from an on-line directory. The available taxis are entered in a stand-by memory. The taxis in first place in the stand-by memory is provided with the assigned address by the switching communications device via radio. The total area serviced by the device for the switching communications exchange of the taxis, can be partitioned into individual sectors, whereby each sector then corresponds to its own stand-by memory. Therefore, a very quick and efficient switching communications exchange is possible without a large expenditure for personnel.

15 Claims, 1 Drawing Sheet

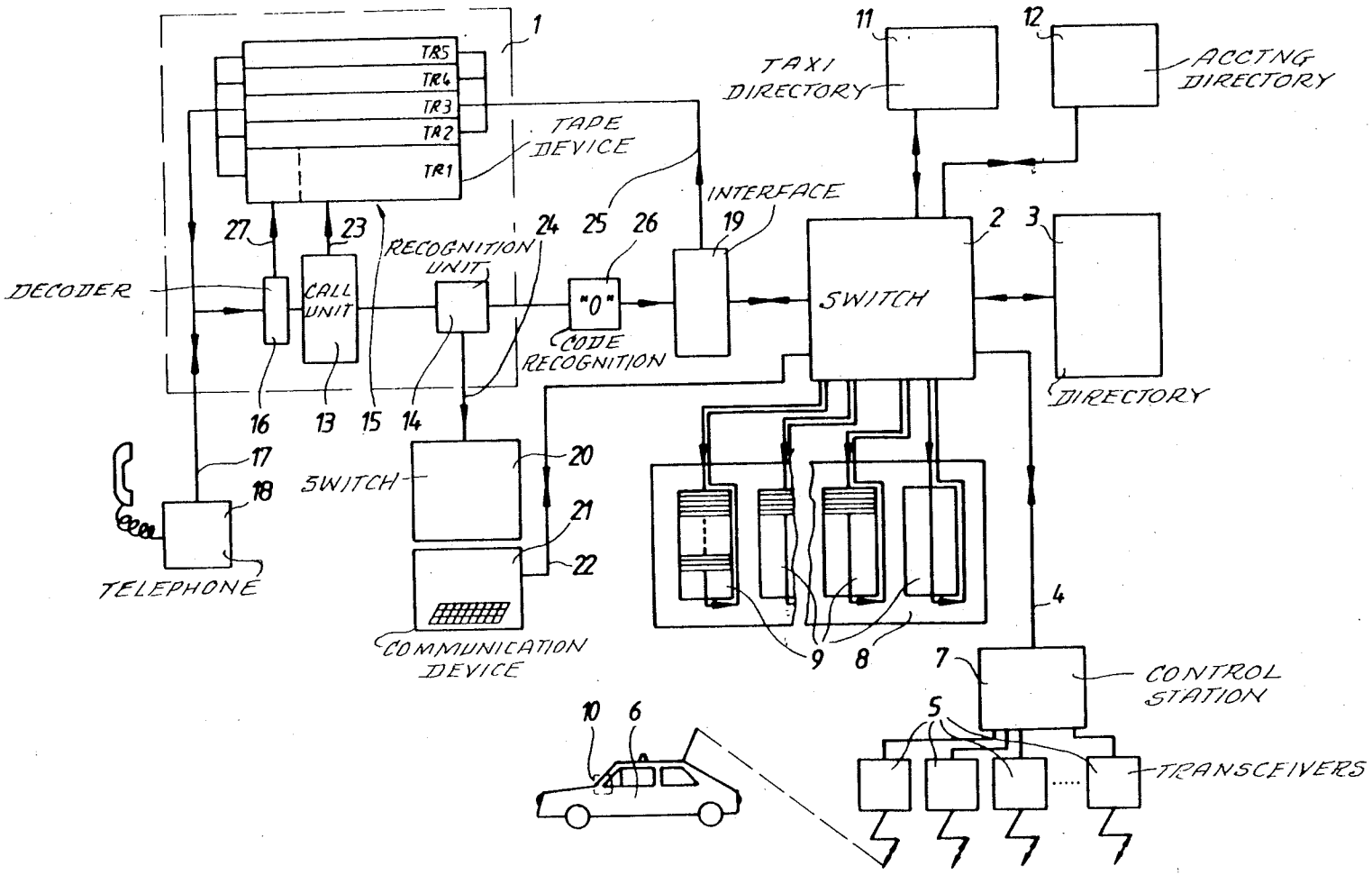
ACCTNG DIRECTORY
TAXI DIRECTORY
DIRECTORY
SWITCH
CONTROL STATION
TRANSCEIVERS
INTERFACE
TAPE DEVICE
"0"
CODE RECOGNITION
RECOGNITION UNIT
CALL UNIT
SWITCH
COMMUNICATION DEVICE
TELEPHONE
DECODER
TR5
TR4
TR3
TR2
TR1
1
2
3
4
5
6
7
8
9
10
11
12
13
14
15
16
17
18
19
20
21
22
23
24
25
26
27

DEVICE AND METHOD FOR SWITCHING COMMUNICATIONS AMONG TAXIS

The invention concerns a device and a method for switching communications among commercial passenger vehicles, especially taxis, operating in an area accessible by radio, and among users, who can be connected by telephone with a central telephone exchange.

Devices that are well-known today or methods of the type mentioned—whether it be for switching communications among taxis, messenger vehicles, or also operational vehicles or the like—require at least one person to receive the incoming user calls, to inform the taxis in question by radio of the pick-up address, as well as to retransmit a code number for the first taxi to accept the assignment, together with an approximate travel time, to the user. As the number of switching exchanges relayed in a specific time period increases, so does naturally the number of required personnel, as well as, to a certain extent, the requirements for space and equipment. In other words, if the number of personnel is not increased, then the length of time until a switching exchange is realized increases, which is unwelcome and disadvantageous to the operators of the devices, as well as to the users.

In connection with the well-known devices or methods of the type mentioned, an additional disadvantage for the operators of the taxis, themselves, is that the circumstances that determine which one of the several available taxis actually receives a certain assignment, depend for the most part on which driver is the fastest to activate an acceptance key or to retransmit his code number to the central exchange. At the same time, it makes absolutely no difference, if the specific taxi had already been waiting a long time for the switching exchange, or if he had just coincidentally been passing by and happened to be available. Also, it cannot always be insured that taxis are called upon that are actually in the area closest to the pick-up address, which, again, is a further disadvantage for the user.

SUMMARY

The goal of the invention at hand is to develop a device or a method of the type mentioned in the beginning, to avoid the disadvantages mentioned, and especially to insure an almost fully automatic switching exchange, which would be simple, fair, efficient and fast, to relay taxis to the users, while involving the least possible amount of active collaboration by service personnel.

According to the invention, this is achieved by a device of the type mentioned in the beginning, in that the central telephone exchange is connected to an automatic switching communications device, and that a user directory is provided in the access area of the switching communications device, which is retrievable by telephone numbers and contains the address corresponding to a specific user telephone number, that the switching communications device is connected via a data transmission circuit to a radio control station, which is in communication with the taxis via transmitters and receivers, that a memory device is provided, which is connected to the switching communications device and has at least one stand-by memory for the message transmitted from a taxi that it is available, and that in each taxi an indicating device is mounted to display the pick-up address, which can be activated from the switching communications device via the radio control station. The method according to the invention for switching communications between one of the commercial passenger vehicles, especially taxis, operating in an area accessible by radio, and a user, who is connected by telephone to a central telephone exchange, is characterized by the following steps:

(a) The user is requested by a tape recording, which is activated when the telephone connection is established, to dial on his telephone either a code number or the telephone number corresponding to the pick-up address, (b) the dialed number is then fed to a recognition unit, which —alternatively—effects the following:

($b_1$) if the code number is dialed, the user is connected by telephone with a manual switching position, from where further service will be provided;

($b_2$) if a telephone number is dialed, then it is relayed, possibly after being electronically edited, to an automatic switching device;

in the case of ($b_2$), next (c) a user directory, invoked by the switching communications device, responds to telephone numbers and determines the address together with all other possible user data corresponding to the dialed telephone number, (d) in a memory device, a stand-by memory is invoked, which contains all the available taxis in their log-on sequence, (e) when the stand-by memory is invoked, the switching communications device informs the taxi in the first position by radio of the user data, and - provided that the arranged pick-up is confirmed (f) a tape recording is activated by the switching communication device, which relays a corresponding message to the user by telephone and (g) the arranged pick-up is added to an accounting directory via the switching communications device.

Thus, an automatic switching communication device is provided, which is directly connected to the central telephone exchange, and is informed of a telephone number directly by the user who is calling, and, for example, is requesting a taxi, except when contact with a manual switching position is desired, by dialing a code number—"0" for example would be suitable. Now, the switching communications device can determine very simply the relevant data, especially of course the pick-up address, from the user directory—which one can picture, for example, as a data file, similar to a telephone book arranged by telephone numbers. After that, or even simultaneously, the taxi in first position in the waiting list is called up by the switching communications device in the stand-by memory and then, subsequently informed by the radio control station or the radio data transmitter triggered by the radio control station of the pick-up address and all other possible user data. In this way, for example, in a very short time after the user calls up, a taxi driver can see the pick-up address on a monitor, a printer, or similar device, and confirm the switching communication by radio. Thus, a very simple, extremely fast switching communication among taxis and users is possible, which in the most favorable of normal operating conditions, requires no personnel whatsoever, and, in addition, insures for the operators of the taxis the advantage of a fair distribution of the incoming assignments, which is not dependent on chance.

An advantageous development of the method according to the invention, whereby the user is connected to the central telephone exchange via a digital dial-up telephone network provides that in step (a) the user is offered two different code numbers, that in step (b) the alternative ($b_1$) follows for the first of these code numbers, and that in a further alternative step ($b_3$) after dialing the second code number, at least a part of the digital switching packet containing the telephone number of the connected user is transmitted to the switching communications device, upon which steps (c) to (g) follow.

Since nowadays in the forcibly introduced digital dial-up or telephone communications, when establishing the connection, the party that is called has available in a so-called digital switching packet the caller's telephone number and possibly also other characteristics, which in this case are not of interest. In this connection, the somewhat inconvenient entering of one's own telephone number—which, even in the case of a telephone with a number storage device normally cannot be stored—can be eliminated by dialing the second code number (naturally it can also be multiple-digit), which, so to speak, represents the assignment to transmit the switching packet, possibly after first editing it, and, thereby, transmit the user telephone number to the switching communications device.

A development of the device according to the invention is very advantageous, especially when the taxis operate in larger local areas, in other words in larger cities or districts, which are handled by such a device. According to this development, for each user telephone number in the entire area accessible by radio, the user directory contains a designation for the sector that each address is assigned to, whereby the memory device features a separate stand-by memory for each of these sectors. There is a corresponding advantageous improvement to the method according to the invention, in that in the step in which the user directory is invoked by the switching communications device, in the entire area, the designation for the sector the address is assigned to is determined additionally, and that in the step in which the stand-by memory is invoked by the switching communications device, the stand-by memory is actually invoked, which contains the available taxis in the concerned sector in their log-on sequence.

In this way, when a large area is partitioned into small sectors in a suitable manner, it can be insured that only taxis will be called upon that are in the sector where the pick-up address is. Within the individual sectors, as before, the sequence is given according to the sequence that the individual taxis have logged on, which corresponds to the sequence in the stand-by memory.

In accordance with another advantageous development of the device according to the invention, as least one feedback line between the switching communications device and the central telephone exchange is provided, via which at least one connected tape recording can be activated, the output of which can be through connected to the user, who is connected by telephone. With this feedback, after a successful switching communication, not only can the user receive a confirmation of the communication, as well as a code number or the like for the anticipated taxi, but he will also be given quickly and automatically relevant information about the estimated arrival time.

In the connection last mentioned, a further development of the method according to the invention is very advantageous, according to which for the case that in the method step, whereby the taxi in first place in the invoked stand-by memory is picked out by the switching communications device, and no taxi is located in the stand-by memory assigned to the specific sector, then, before the next step, the stand-by memory of the neighboring sector is invoked in a predetermined sequence. In this simple way, it is insured for the user, that the taxi subsequently assigned to him by the switching communications device will arrive in the shortest time possible, because the sequence in which the other sectors are invoked is determined simply by the increased distance from the sector to be travelled to. At the same time, the feedback of the estimated arrival time to the user can depend in a very simple way on the other sectors being invoked by the stand-by memory, the greater the distance of the sector, in the stand-by memory of which at least one waiting taxi is found subsequently, from the sector to be travelled to, the longer the expected arrival time will be, which for example permits the use of the recorded announcements staggered in specific minute intervals or the like.

According to a further development of the device according to the invention, in the access area of the switching communication device, a taxi directory connected to the device is arranged, with characteristics of all taxis available to the switching exchange, which, if necessary, make it possible to consider specific details such as, for example, size of the trunk space, availability of luggage racks for the roof, non-smoker cabs, or the like. Also, in this way, any use of the switching communication service by unauthorized vehicles can be eliminated.

According to another advantageous development of the invention, an accounting directory connected to the switching communication device can be provided, which includes data on the rides assigned for each taxi. This provides a simple method to make the fees that the drivers of the individual taxis pay to the operators of the switching communication device automatically contingent on the switching exchanges which actually took place.

According to another development of the invention, the switching communications device can be connected to an input-output terminal, from which the contents of the user directory, the taxi directory and the accounting directory can be controlled. In this way, the operator of the device according to the invention or, as the case may be, the user of the method according to the invention, can, on the one hand, intervene actively or in a controlling manner and, on the other hand, undertake the required up-dating of the mentioned directories.

In another connection, according to a very advantageous form of construction of the invention, it is provided that the central telephone exchange features a number recognition unit, which is connected to the automatic switching communications device, and its output is connected to a manual switching position. This number recognition unit makes it possible for the user to make the selection as mentioned briefly in the beginning in connection with the method according to the invention, if he would like to request a taxi directly via the automatic switching communications device without the assistance of a service person, of if—for whatever reason—would like advice or some other personal service from the switching position. Usually, this recognition unit would respond to "0", as this, at least in most telephone systems, is the first area code number for other local exchange networks and, therefore, for the most part, is eliminated as a user's telephone number, for example, from local taxis.

In another form of construction of the invention, between the central telephone exchange and the automatic switching communications device, a code recognition unit can be connected, which responds to abbreviated numbers which are not tied to a specific address. In this way, abbreviated numbers from, for example, larger organizations, agencies, or the like, that are not tied to a specific address, can be switched off by the automatic switching communications device; for the specific user, there is still, as mentioned above, the direct contact with the manual switching position by dialing a specific identification number.

According to another development of the invention, the indicating device in each of the taxis available to the switching communications device can also include a sector selection device which is connected in reverse by radio with the switching communications device. This would enable, for example, the driver of a taxi in a very overfilled sector to move over to another sector, whereby there he would place himself last in the waiting line, which, however, would be advantageous for only a few of the vehicles operating in this new sector.

In the connection last mentioned, another form of construction of the invention is especially advantageous, according to which the indicating device in each taxi features an output element for its current position in the stand-by memory of the selected sector, so that it can be determined immediately, for example, how many taxis in one's own sector are in front in the waiting list in the stand-by memory, whereby after possibly moving over to the other sector, this information is again available immediately. At the same time, it would also be feasible not to associate this search for a more favorable waiting position directly with the transfer to another sector, instead to enable the selection of the sector to be made separately, which would provide further advantages to the driver of the individual taxi.

According to another proposal, the method according to the invention can subsequently still be developed, in that after the specific taxi has accepted the arranged ride assignment, the stand-by memory, reduced in size by the assigned taxi, is reorganized, whereby this reorganization can also naturally be effected after a taxi somewhere in the middle of the waiting list in the stand-by memory has been transferred to another sector. In both cases, an organized waiting list, which is as short as possible, ensues in the specific stand-by memory, which especially greatly simplifies the possibility to get information, as mentioned above, about the specific position in the waiting list and helps to save storage space.

BRIEF DESCRIPTION OF THE DRAWING

In the following, the invention will be clarified in greater detail based on the flow diagram of FIG. 1.

DETAILED DESCRIPTION

The represented device for the largely automatic switching communication of taxis consists essentially of a central telephone exchange 1, with an automatic switching communication device 2 connected to it, which has on line a user directory 3, of a radio control station 7 connected to the switching communications device 2 via a data transmission circuit 4, which is in communication by transmitter and receiver 5 with the taxis to be assigned 6, as well as a memory device 8 with stand-by memories 9. The vehicle 6, especially a taxi or such, not depicted any further here, equipped with a radio transmitter-receiver, is provided with an indicating device 10 in the driver's field of vision, which can respond to the switching communications device 2 via the radio circuit. Also, in the access area of the switching communications device 2, a taxi directory 11 connected to the device is arranged, which contains characteristics of all the taxis 6 available to the switching exchange. Furthermore, an accounting directory 12 is connected to the switching communications device 2, which contains data on the rides assigned to each taxi 6.

The central telephone exchange 1 includes for the most part a call unit 13, a "0" recognition unit 14, a tape recording device 15, in this case with five individual tape recording stations TR 1 to TR 5, as well as a unit 16, which makes it possible to utilize the information about the caller transported by the so-called switching packet, in connection with the digital or telephone communications—this will be explained in greater detail later in the description of a switching communication procedure. A user's telephone set 18 can be connected to the central telephone exchange 1 via the trunk line 17, of which there can be as many as needed. Here also a code recognition unit 26, the function of which will be mentioned briefly later, as well as an interface module 19 are enabled here also between telephone exchange 1 and switching communication device 2. Finally, a manual switching position 20 is also connected to the "0" recognition unit 14. This switching position can also be spatially accommodated, together with an input-output terminal 21, which is connected directly with the switching communications device via a transmission line 22, which allows the procedures controlled by the switching communications device or, as the case may be, the contents of the directories 3, 11, 12 to be controlled or influenced by a service person.

In the constructional example depicted, the memory device shows a larger number of stand-by memories 9, which correspond to the number of sectors into which the entire operating area of the taxis 8 that is accessible by radio is partitioned. In this connection, it is irrelevant if these individual sectors correspond to individual local districts of a larger city, or if they signify an arbitrary partitioning of the entire area. The available taxis 6 waiting for a user in one sector log on by radio to the switching communications device 2, whereby specific sectors are usually assigned a specific radio channel. The stand-by memory 9 for a specific sector is filled up in the sequence that the log-ons arrive, whereby the length of the waiting list will vary according to the number of available taxis in each sector. This insures, first of all, that the available taxis are partitioned by sectors ready to be called upon and are available via memory device 8.

The user directory 3 is organized in file form, whereby for the most part, as access parameters, only the telephone numbers of the users are available. At the same time, it is possible to install a comprehensive user directory, which, at the outset, would contain all potential users—this means, for the most part, everyone who has a telephone in the operating area of the taxis, or also a user directory which would be supplemented only upon special application or such via the terminal 21. For each of the user telephone numbers obtained in one of the two ways, each corresponding address and its overriding sector is available in the user director, whereby it would also be feasible to keep the sector partitioning in a separate file for increased flexibility, which, for each access, could be addressed separately via the specific address. In the user directory 3, in addition to the address and sector for each user telephone number, special data or customer requirements can also be stored, such as for example the request for a certain type of taxi in connection with a user's physical disability, or the request for a non-smoking taxi, etc.

In order to insure a smooth switching communications service, it can be provided in a way not further represented here, that the switching communications device 2 automatically connects the user with the switching position 20, in case no user data or insufficient user data appear in the user directory 3 for the telephone number he has entered.

As already mentioned, the taxi directory 11 contains characteristics of all the taxis 6 which are available to the switching exchange and thereby makes it possible to consider the customer requirements as mentioned above, and to eliminate the taxis which are unauthorized to the switching exchange.

A user who wishes to arrange for a commercial passenger vehicle such as a taxi by dialing the central telephone exchange 1 with his telephone set 18 over the trunk line 17, will first reach unit 16, which for the case that it is an analog dial or telephone connection will remain inactive or will simply reroute it to the call unit 13, which, via a line 23, starts the recording unit TR 1, which retransmits to the telephone set 18 on an endless tape, for example, the text "Please dial your own telephone number of dial "0" for the exchange". Now, if the user dials a "0" on his telephone set 18, then the manual switching position is picked up via the "0" recognition unit 14 over line 24, from where advice or active support is received for the next arranged taxi. If the user, however, dials on his telephone set 18 his own telephone number or the telephone number of an address where the taxi is needed, then the "0" recognition unit 14 transfers the connection to the code-recognition unit 26. In this case, abbreviated call numbers, which are not associated with a specific address, are intercepted and the corresponding connections, for example, in a way not further depicted here, are also rerouted to the manual switching position.

As far as the code recognition unit 26 does not respond, the telephone number entered by the user is fed over the interface module 19 directly to the automatic switching communications device 2, which is the first to call up the user memory device 3 and determine the corresponding user data—especially address and sector identification. Then, with the sector designation, the taxi in the first place in the corresponding memory 9 is determined and - as far as the taxi-specific characteristics in the taxi directory 11 do not come up with any objections, it is contacted directly via the radio control station 7 or the transmitter/receiver units 5. In the vehicle 6, the assigned address will be displayed in the indicating device 10, which can be configured as a TV monitor or a printer, or the like. At this point, the driver of vehicle 6 can press a confirmation key, or such, as a sign that he accepts the transmitted ride assignment, which, on the other hand, is retransmitted by radio to the switching communications device 2.

From the switching communications device 2, one of the tape recording units TR 2 to TR 5 can be started again over the interface module 19 and the line 25, which sends out a corresponding feedback acknowledgements to the user's telephone set 18. Possible texts for the tapes of the tape recording units 2 to 5 would run, for example, as follows:

For TR 2: "Your taxi will come in 5 minutes"—this text is then started by the switching communications device 2, if an available taxi is located directly in the assigned sector or in a directly neighboring sector, which has also confirmed the switching exchange. For TR 3: "Your taxi will come in 10 minutes"—this text is only started by the switching communications device 2, if in the stand-by memory 9 of the assigned sector or, as the case may be, also no waiting, available taxi is located in the standby memories of the directly bordering sectors, and there is a confirmation of the switching exchange from a taxi in a sector which is further away;

For TR 4: "Unfortunately, at the present time, no taxi is available" —this text is invoked by the switching communications device 2 for the case, that every standby memory in question of the memory device 8 does not show any taxis that have reported that they are available;

For TR 5: "Your address is not known, please dial "0" for the switching exchange"—this text can be started by the switching communications device 2, if there are not any data corresponding to the dialed telephone number in the user directory 3, as far as in this case, a connection is not automatically made with the switching position, or, for example, it can also be retransmitted to the user, if the attempt to reach the automatic switching exchange via the code recognition unit 18 is interrupted.

When the switching exchange is confirmed by the driver of taxi 6, the switching communications device 2 activates the accounting directory 12, by adding to it the assigned rides, and settles the account of the operator of the specific taxi.

If the user is calling up over a telephone or dial network exchange that already has a digitalized operation, the digital switching packet that also contains the telephone number of the telephone set that is calling is recognized as such by the unit 16, which at first prevents a direct transfer. For this case, another tape recorded text is started via line 27, here it is only symbolized by the lined partitioning of TR 1, for example, "If you would like to have a taxi sent to your address, please dial "99" on your telephone set. If you would like to have a taxi sent to another address, please dial the corresponding telephone number on your telephone set. Otherwise, please dial "0" for the exchange." If then the user dials the code number "99" (of course, another code number could be suitable) on his telephone set, which is always considerably simpler than dialing his own number, which could be a relatively long telephone number, the assignment to transfer the switching packet, or at least the user telephone number out of this packet to the switching communications device 2 is evaluated, upon which, as described above, the further procedures will begin or be introduced.

The indicating device 10 of each taxi 6 can include—in a way not depicted here—a sector selection device retransmitted by radio to the switching communications device 2; furthermore an output element for one's own place in the stand-by memory for the chosen sector can be provided—also in a way not depicted here—on this indicating device 10. Both of these measures make it possible for the driver of taxi 6 to leave a relatively full sector from an unfavorable waiting position, and to take his place in the waiting line in the stand-by memory 9 in another sector. As soon as the first taxi of a stand-by memory is eliminated from the waiting line by the confirmed switching exchange of an assigned ride, or if a taxi waiting further back in the line drops out of the waiting list because he switches over to another sector, then this or the corresponding stand-by memory 9 will each be reorganized, which allows at any time a control of the taxis next in line in the stand-by memory of each sector and, thereby, an optimum utilization of the switching communications device.

Finally, it should be pointed out that individual parts of the represented device can be realized very simply with software, which does not affect the total set-up or the entire function of the device. Also, the individual parts of the device can be spatially separated without any problems, which otherwise is more practical for the radio control station or the corresponding transmitter/-receiver units. The connections between the individual subassemblies of the device could be made, for example, over data lines, over radio link routes, or other suitable ways. Here, we have not examined further the possibilities of direct radio communication from the control exchange to the taxis, direct telephone connection to the switching position, or the like.

I claim:

1. A device for switching communications among commercial passenger vehicles, especially taxis, operating in an area accessible by radio, and among users who can be connected by telephone with a central telephone exchange, characterized in that the central telephone exchange (1) is connected to an automatic switching communications device (2), that in the access area of the switching communications device (2) connected to this is a user directory (3) retrievable by telephone numbers is arranged, which contains an address corresponding to a specific user telephone number, that the switching communications device (2) is connected via a data transmission circuit (4) with the radio control station (7) which is connected to the taxis (6) via transmitter and receiver (5), that a memory device (8) is provided, which is connected to the switching communications device (2) and features at least one stand-by memory (9) for the taxi (6) which has reported in that it is available, and that in each taxi (6) an indicating device for the assigned address (10) is arranged, which can be activated by the switching communications device (2) via the radio control station (7).

2. A device according to claim 1, characterized in that in the user directory (3) for each user telephone number a designation is also included of the sector that the specific address is assigned to, of the entire area accessible by radio, and that the memory device (8) features separate stand-by memories (9) for each one of these sectors.

3. A device according to claim 1 or 2, characterized in that at least one feedback line (25) is provided between the switching communications device (2) and the central telephone exchange (1), through which at least one connected tape recording device (15) can be activated, the output of which can be switched through to the user connected by telephone.

4. A device according to one of the claims 1 to 3, characterized in that in the access area of the switching communications device (2) connected to it is a taxi directory (11) with characteristics of all the taxis available to the switching exchange.

5. A device according to one of the claims 1 to 4, characterized in that an accounting directory (12) connected to the switching communications device (2) is provided, which contains data about the arranged rides for each taxi (6).

6. A device according to one of the claims 1 to 5, characterized in that the switching communications device (2) is connected to an input-output terminal (21), through which also the contents of the user directory (11) and the accounting directory (12) can be controlled.

7. A device according to one of the claims 1 to 6, characterized in that the central telephone exchange (1) features a number recognition unit (14) connected to the automatic switching communications device (2), the output of which is connected to a manual switching position (20).

8. A device according to one of the claims 1 to 7, characterized in that between the central telephone exchange (1) and the automatic switching communications device (2) a code recognition unit (26) is connected, which respond to abbreviated call numbers not associated with any specific address.

9. A device according to one of the claims 2 to 8, characterized in that the indicating device in each of the taxis available to the switching exchange, also contains a sector-selection device with a reverse connection via radio to the switching communications device.

10. A device according to claim 9, characterized in that the indicating device of each taxi features an output element for its current position in the stand-by memory of the selected sector.

11. A method for switching communications among commercial passenger vehicles, especially taxis, operating in an area accessible by radio, and among users who can be connected by telephone with a central telephone exchange, characterized by the following steps:

(a) the user is requested by a tape recording device which is activated when the telephone connection is established, to dial either a code on his telephone set or the telephone number corresponding to the address to be driven to, (b) the number that is then dialed is fed to a recognition unit which—alternatively—effects the following:

($b_1$) if the code number was dialed, the user is connected by telephone with a manual switching position, from where further service is provided;

($b_2$) if a telephone number is dialed, then it is transferred, if necessary after an electronic editing, to an automatic switching communications device; in case ($b_2$), next (c) via the switching communications device, a user directory is called up which is invoked by telephone numbers, and determines the address corresponding to the telephone number dialed together with other possible user data, (d) in a memory device, a stand-by memory is invoked, which contains all of the available taxis in their log-on sequence;

(e) that the taxi in first place in the invoked stand-by memory is provided with user data by the switching communications device via radio; and—provided that the transmitted ride assignments are confirmed by radio (f) via the switching communications device, a tape recording device is started which retransmits a corresponding message by telephone; and (g) via the switching communications device, the assigned rides are added to an accounting directory.

12. Method according to claim 11, whereby the user is connected to the central telephone exchange via a digital dial-up telephone network, characterized in that in step (a) the user is offered two different codes, that in step (b) the alternative ($b_1$) follows for the first of these codes, and that in another alternative step ($b_3$) after selecting the second code, at least a part of the digital switching packet already containing the telephone number of the connected user is transferred to the switching communications device, upon which the steps (c) to (g) follow.

13. Method according to claim 11 or 12, characterized in that in step (c) from the user directory, in addition, the designation of the sector of the entire area that the address is assigned to is determined, and that in step (d) the stand-by memory is invoked, which contains the taxis that are available in the specific sector in their log-on sequence for this sector.

14. Method according to claim 13, characterized in that for the case that in step (d) no taxi is located in the stand-by memory assigned to the specific sector, before the step (e) (h) the stand-by memories of the neighboring sectors are invoked in a predetermined sequence.

15. Method according to one of the claims 11 to 14, characterized by, that in the same order as steps (f) or (g), the stand-by memory, reduced by the relayed taxi, is reorganized.

* * * * *